US005843551A

United States Patent [19]

Lee et al.

[11] Patent Number: 5,843,551

[45] Date of Patent: Dec. 1, 1998

[54] MONEY CAKE APPARATUS

[75] Inventors: Eleanor Gallegos Lee, 9040 Redwater Dr., Antelope, Calif. 95843; Edmund Y. Lee, Antelope, Calif.; Maryann Vigil Martinez, Espanola, N. Mex.

[73] Assignees: Eleanor Gallegos Lee; Edmund Lee, both of Antelope, Calif.

[21] Appl. No.: 755,417

[22] Filed: Nov. 22, 1996

[51] Int. Cl.[6] ..... B32B 3/10; B32B 1/06

[52] U.S. Cl. ..... 428/43; 428/66.6; 428/120; 248/188.1; 99/484

[58] Field of Search ..... 428/120, 43, 64.1, 428/66.6, 7; 221/45, 46, 70, 71; 248/188.1; 99/484

[56] References Cited

U.S. PATENT DOCUMENTS 769,963 9/1904 Sexton ..... 221/46
4,219,119 8/1980 Zefran ..... 206/457
4,330,060 5/1982 Thornton ..... 206/459
4,705,163 11/1987 James ..... 206/45.32
5,056,683 10/1991 O'Brien et al. ..... 221/64

*Primary Examiner*—Alexander Thomas
*Attorney, Agent, or Firm*—John P. Costello

[57] ABSTRACT

A money cake apparatus, is disclosed, which gives the appearance of cash money being pulled from a birthday cake. This apparatus is comprised of a hollow base having one or more spout extensions with open ends, protruding upward from the top of the base. A cake is mounted upon the base after having through-holes cut therein for accommodating the spout extensions. In the preferred embodiment, a see-through glassine or plastic money strip, having individual adjacent compartments, acts as a means for delivering currency from the hollow base up through the spout extensions. Bills of currency are placed in each compartment and protected therein from cake and frosting debris as each bill is pulled, one by one, from the money cake apparatus.

16 Claims, 3 Drawing Sheets

MONEY CAKE APPARATUS

BACKGROUND OF THE INVENTION

1. Field of the Invention

This invention pertains to party accessories, and more specifically, to an accessory for adapting a birthday cake to produce a gift of currency.

2. Description of the Background Art

Birthday cakes have been a customary accouterment at birthday parties for a number of years. Candles, decorative writing, and figurines, include some of the accessories which have been added to birthday cakes, to enhance their decorative and celebrational aspects.

Moreover, gift giving has also been a customary activity practiced at most birthday parties. Among the gifts given at birthday parties, cash money has always been very popular. Money is often given at birthday parties in an innocuous conveyance such as a plain envelope, birthday card, or other means, which, in themselves, do not inspire excitement.

The present invention seeks to combine the celebrative features of a birthday cake, with the practice of giving money as a gift, at birthday parties. Additionally, this invention provides a conveyance for giving money which increases the level of presentation and excitement in the act of giving money as a gift.

The foregoing information reflects the state of the art of which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

SUMMARY OF THE INVENTION

By way of example, and not of limitation, the present invention pertains to an apparatus for mounting a birthday cake upon, the apparatus being further adapted to presenting a plurality of dollar bills, or other currency, in any selected denomination, to the lucky birthday celebrant. This invention is comprised of a hollow base having one or more elevated spout extensions protruding upward from the top surface of the base, these spout extensions having openings at their uppermost ends. These openings are designed to be at a height substantially level with the top surface of a birthday cake. Additionally this invention further comprises a means for delivering the currency from the cake, through the spout extension, to the birthday celebrant. To use this apparatus, a hole is cut into the birthday cake to accommodate the spout extension, and the cake is subsequently mounted upon the apparatus with the spout extension protruding upward, through the cake.

From the opening in the spout extension, the birthday celebrant pulls a plurality of dollar bills, or other currency, seemingly out of the cake, to the delight and amazement of all present at the birthday celebration. Naturally, this apparatus can be used with any type of cake, be it a birthday cake, wedding cake, or other type of cake.

Accordingly, this invention will be more fully understood through the following objects and advantages:

An object of the invention is to provide an accessory for combining the celebrational aspects of birthday cakes, with gifts of money, at birthday parties.

Another object of the invention is to provide a conveyance for giving money at parties which increases the level of presentation and excitement in the act of giving money as a gift.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
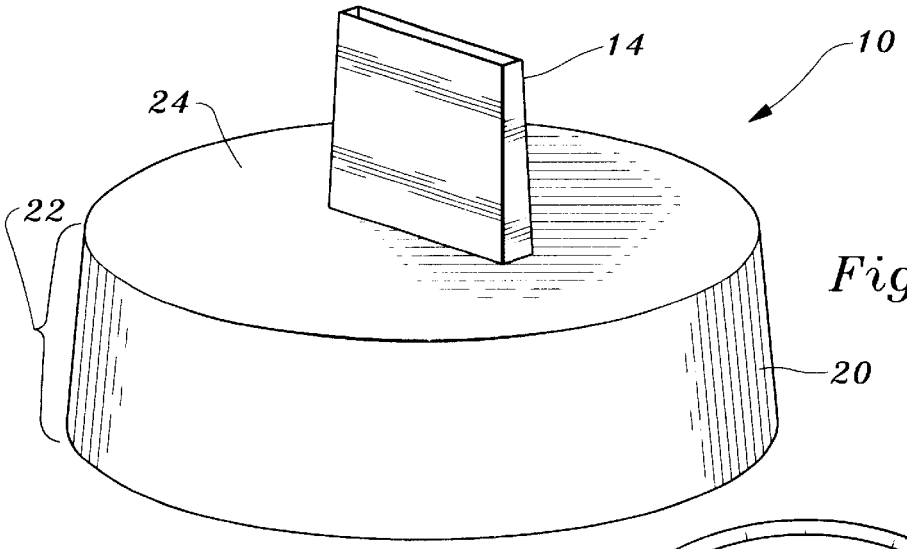
FIG. 1 is a perspective view of the money cake apparatus which is the present invention.
Figure 2:
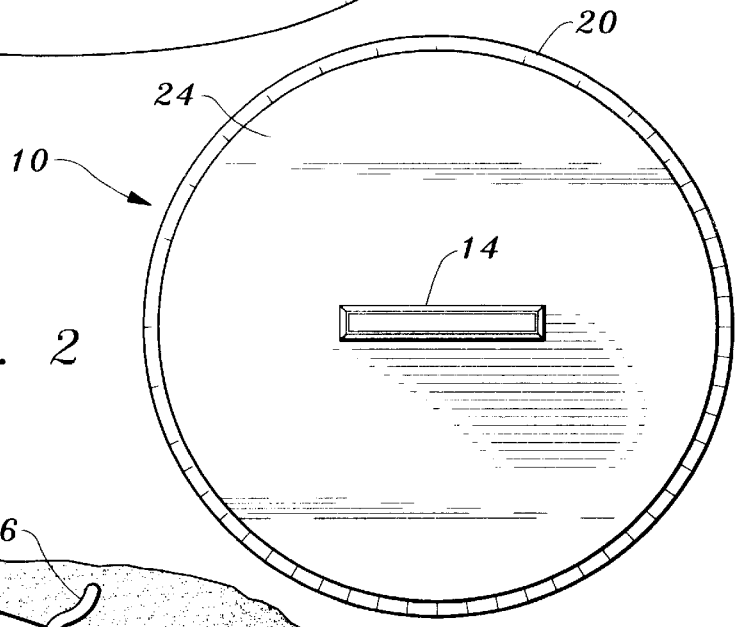
FIG. 2 is a top plan view of the money cake apparatus which is the present invention.
Figure 3:
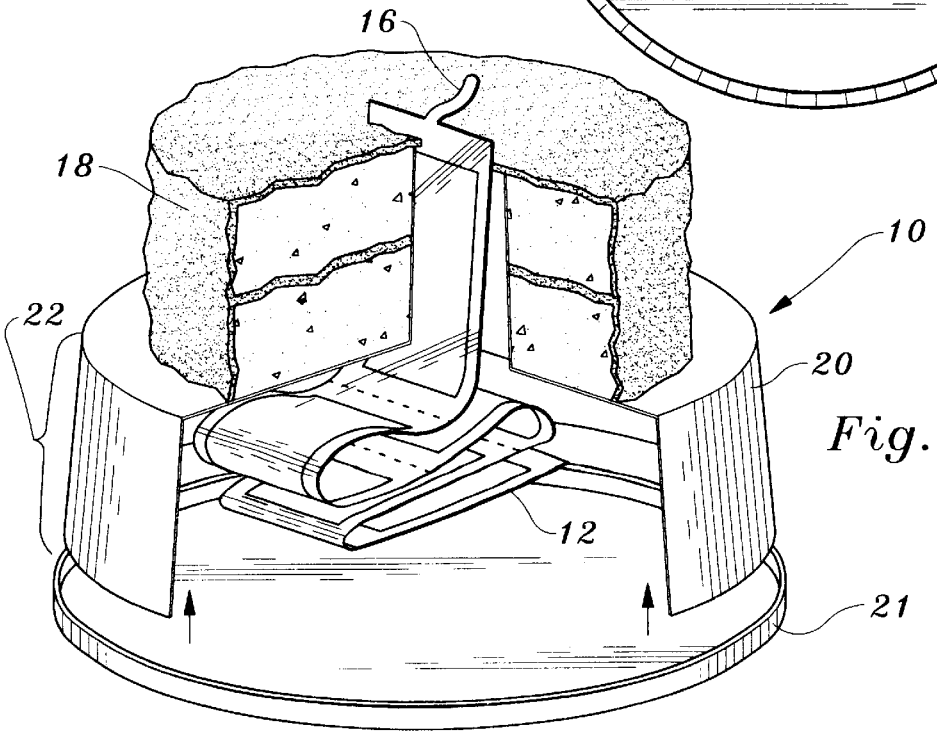
FIG. 3 is an elevated side cutaway view of the money cake apparatus, with a cake shown positioned upon the apparatus, and the currency delivery means mounted in the spout extension.

Referring more specifically to the drawings, the money cake apparatus 10 which is the present invention is shown generally in FIGS. 1 and 2. FIG. 3 is a side cutaway view of money cake apparatus 10, showing its entire componentry, including currency delivery means 12 which is shown emerging from spout extension 14. A pull tab 16 can be attached to at least one end of currency delivery means 12, allowing a birthday celebrant a grasping surface, for pulling the remainder of currency delivery means 12 from cake 18, one bill at a time.

Currency delivery means 12 is stored in hollow base 20 of apparatus 10. Base 20 is comprised of sidewalls 22 which terminate at a level top surface 24, upon which cake 18 rests. Base 20 is preferably of a round or square shape, as the majority of cakes are either round or square, however, base 20 can be formed in any of a plurality of shapes to accommodate a similar plurality of cake shapes. The bottom end of base 20 can include a snap-on cover 21 for purposes of containing currency delivery means when the apparatus is carried from a first, to a second, location. Finally, base 20 is preferably colored, or opaque, for purposes of hiding currency delivery means 12 therein, from view by birthday celebrants.

Figure 4:
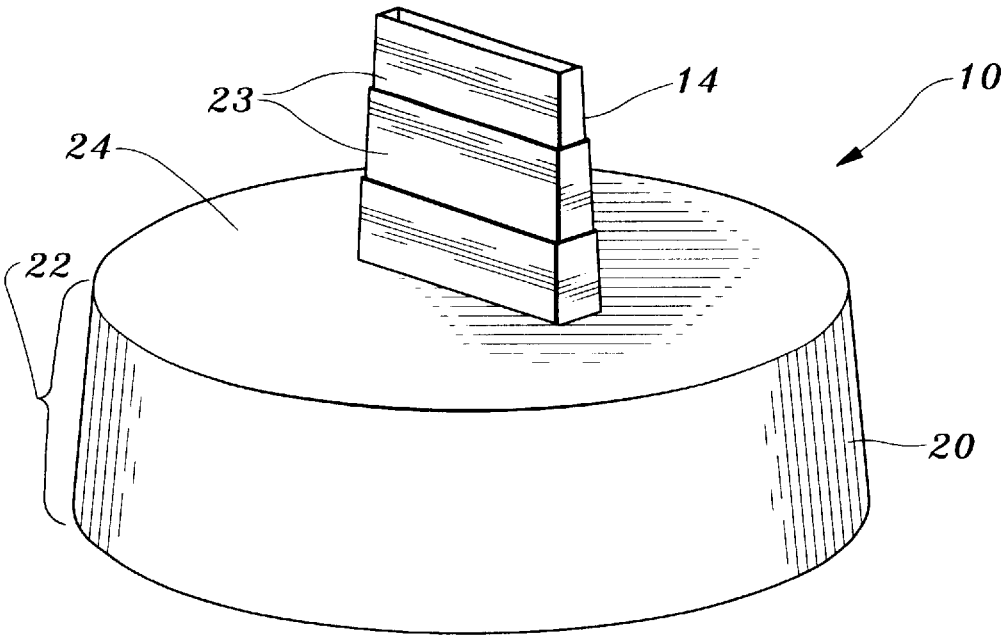
FIG. 4 is a perspective view of a first alternate embodiment of the money cake apparatus, shown with a height-adjustable spout extension.

Spout extension 14 protrudes upward through a hole cut into cake 18, and currency delivery means 12 emerges from the open, uppermost end, of spout extension 14. Spout extension 14 allows currency delivery means 12 to emerge cleanly without frosting, or cake debris attached, thereby increasing the pleasure of the experience of receiving money by the birthday celebrant. Spout extension 14 can be fixedly attached to base 20, or, in an alternate embodiment, spout extension can be made to be height-adjustable to accomodate the height of the cake 18 mounted on base 20. For example, spout extension 14 could be constructed from one or more telescoping members 23, as seen in FIG. 4, or else spout extension could be made to be raised and lowered with a mechanical height adjustment means. The feature of height adjustment would allow spout extension 14 to accommodate cakes of many different heights.

Figure 5:
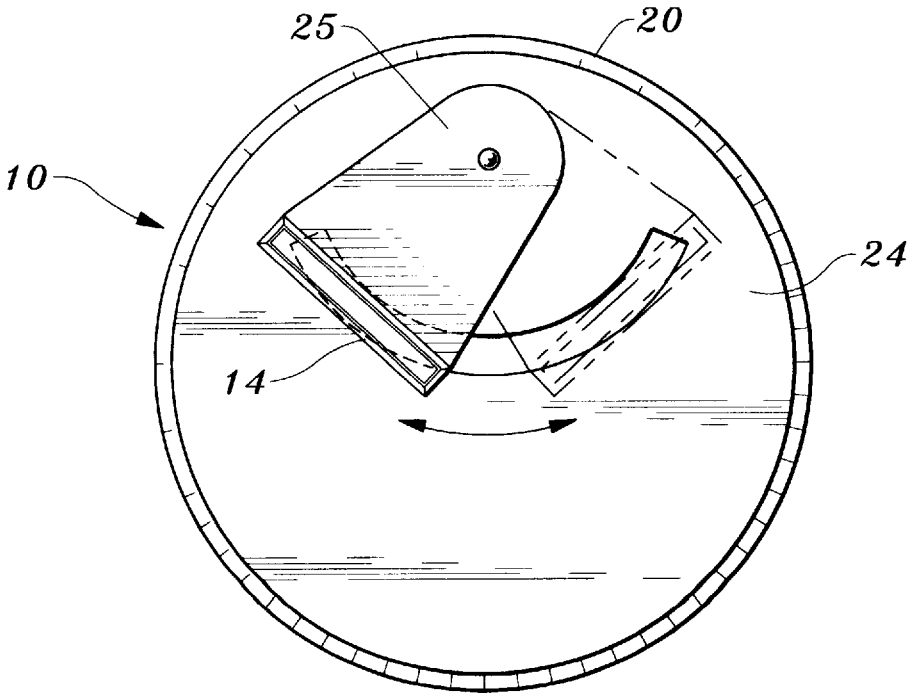
FIG. 5 is a plan view of a second alternate embodiment of the money cake apparatus, shown with the spout extension mounted on a pivoting member.

In a second alternate embodiment, spout extension 14 could be fitted on a pivoting member 25, as seen in FIG. 5, so that it could be moved to different locations upon the top of base 20 to allow currency delivery means 12 to emerge out of a cake from different locations.

Figure 6:
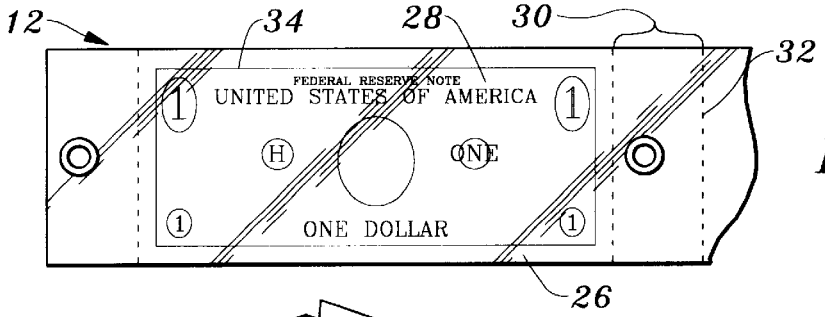
FIG. 6 is a closeup view of the currency delivery means, which is a component of the present invention.

Referring now to FIG. 6, the currency delivery means 12 is shown in detail. While an adequate currency delivery means could be fashioned from a plurality of bills stapled, or taped together, currency delivery means 12 is preferably comprised of a plurality of individual compartments 26 forming an elongate strip, for placing dollar bills 28 or other currency. Compartments 26 are sized to accommodate either United States or foreign currencies, and are preferably made from a see-through glassine, or clear plastic material, for allowing party goers to have an opportunity to view the amount of currency being given to the birthday celebrant. This visual element of being able to view the bills as they emerge, one by one, in their individual compartments 26, creates a high level of excitement for all party goers in attendance. Following a birthday party, currency delivery means 12 can be stored in hollow base 20 and reused at a future date.

A perforated section 30 having perforations 32 connect adjacent compartments 26. Perforations 32 allow for a specified length of currency delivery means 12 to be chosen, by merely tearing off a desired length of currency delivery means. An opening 34 placed along one side, and preferably placed along the top of compartment 26, allows bills 28 to be placed therein. In practice, the number of bills 28 to be placed in compartments 26 is purely at the option of the party goers who prepare the money cake, and is only limited by the volume of base 20 which is used, and the arrangement of the currency delivery means 12 inside of base 20.

Figure 7:
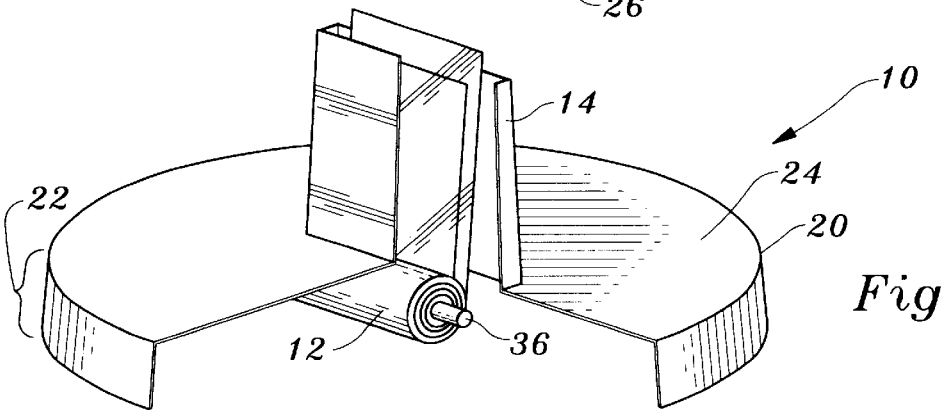
FIG. 7 is a perspective view of a low-profile, third alternate embodiment of the money cake apparatus, which is the present invention.
Figure 8:
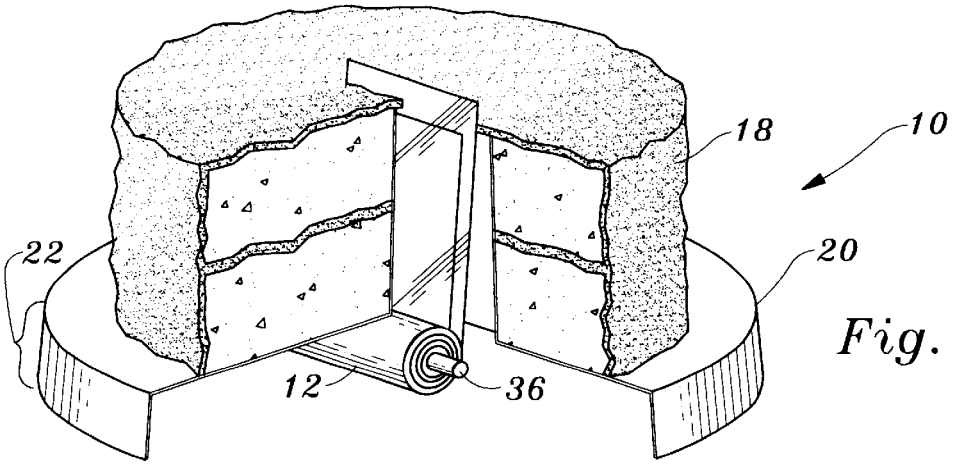
FIG. 8 is an elevated side cutaway view of the money cake apparatus shown in FIG. 7, with a cake shown positioned upon the apparatus, and the currency delivery means mounted in the spout extension.

Referring again to FIG. 3, and additionally to FIGS. 7 and 8, a third, alternate embodiment of the money cake apparatus can be described. This additional embodiment illustrates an alternative method of arranging currency delivery means 12 within base 20. In the embodiment shown in FIG. 3, currency delivery means 12 is shown stacked upon itself, which is a simple arrangement, but not space efficient, and requires a base 20 with tall sidewalls 22 to store a large volume of currency. FIG. 6 presents a low-profile, low volume, embodiment of money cake apparatus 10, which achieves a higher volumetric efficiency, by arranging currency delivery means 12 upon a roller 36, which is then mounted inside of base 20. This embodiment allows a lower profile of base 20 to be used, but if a large roller 36 is desired for the delivery of hundreds of individual bills, then roller 36 could be easily adapted to work with the large volume embodiment of money cake apparatus 10 shown in FIG. 3.

Figure 9:
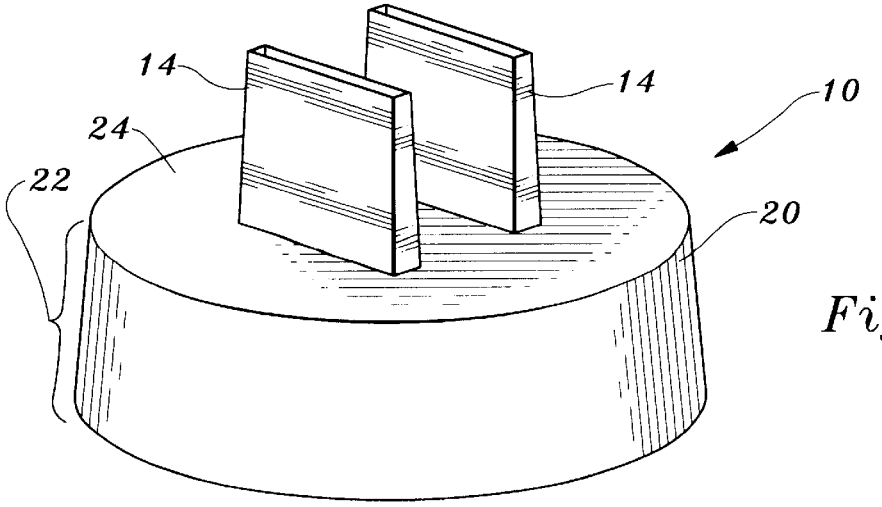
FIG. 9 is a perspective view of a twin-spout, fourth alternate embodiment of the money cake apparatus, which is the present invention.

A fourth alternate embodiment of money cake apparatus 10 is presented in FIG. 9. This embodiment adds the feature of twin spout extensions 14, for party events where twin celebrants are being honored. For example, this embodiment would be useful for anniversary celebrations where a husband and wife are being honored, or where twins, or other persons having the same birthday, are being honored. Finally, twin spout extensions 14 could be modified to have the height adjustment features and pivoting member features previously described for the single spout embodiment.

Accordingly, this invention provides a money cake apparatus which successfully combines the celebrational features of birthday cakes, with giving money as a gift at birthday parties. This apparatus helps create an exciting visual effect in the act of giving money as a gift, as it allows many hundreds of dollar bills to be pulled individually, seemingly from the cake itself.

Finally, although the description above contains many specificities, these should not be construed as limiting the scope of the invention, but as merely providing illustrations of some of the presently preferred embodiments of this invention. Thus the scope of this invention should be determined by the appended claims and their legal equivalents.

We claim:

1. A money cake apparatus, the apparatus comprising:

a) a hollow base, said base further comprising a level top surface for placing a cake, and a sidewall portion depending down from said top surface, said sidewall portion terminating at a bottom end; and b) a spout extension, said spout extension protruding upward from said top surface of said base and terminating at an uppermost end;

c) currency delivery means for delivering currency upwards and out of said spout extension, said currency delivery means further comprising a plurality of connected compartments for enclosing currency therein and delivering said currency free of cake debris from said base to a party celebrant.

2. The money cake apparatus as recited in claim 1, wherein said compartments are joined by a perforated section.

3. The money cake apparatus as recited in claim 2, wherein said money strip further comprises a pull tab coupled to a one of its ends.

4. The money cake apparatus as recited in claim 1, further comprising a roller for mountably supporting said money strip in a rolled manner inside of said base.

5. The money cake apparatus as recited in claim 1, wherein said spout extension includes height adjustment means.

6. The money cake apparatus as recited in claim 1, further comprising a cover coupled upon said bottom end.

7. A money cake apparatus, the apparatus comprising:

a) a hollow base, said base further comprising a level top surface for placing a cake, and a sidewall portion depending down from said top surface, said sidewall portion terminating at a bottom end;

b) a spout extension, said spout extension protruding upward from said top surface of said base and terminating at an uppermost open end;

c) a plurality of connected individual compartments forming an elongate money strip, said compartments being sized for fitting bills of currency, each of said compartments being opened along a one side for placing a bill of currency therein;

d) said money strip being positioned inside of said hollow base with a one end of said money strip being placed inside of said spout extension, said end being pulled to release said money strip from said spout extension and said hollow base.

8. The money cake apparatus as recited in claim 7, wherein adjacent compartments are joined by a perforated section.

9. The money cake apparatus as recited in claim 8, wherein said money strip further comprises a pull tab coupled to said end.

10. The money cake apparatus as recited in claim 9, further comprising a roll for mountably supporting said money strip in a rolled manner inside of said base.

11. The money cake apparatus as recited in claim 10, wherein said spout extension includes means for selectively adjusting its height.

12. A money cake apparatus, the apparatus comprising:

a) a hollow base, said base further comprising a level top surface for placing a cake, and a sidewall portion depending down from said top surface, said sidewall portion terminating at a bottom end;

b) a spout extension, said spout extension protruding upward from said top surface of said base and terminating at an uppermost end;

c) a plurality of connected individual adjacent compartments joined by a perforated section, and forming an elongate money strip, said compartments being sized for fitting bills of currency, each of said compartments being opened along a one side for placing a bill of currency therein;

d) said money strip further comprising a pull tab coupled to a one of its ends;

e) said money strip being positioned inside of said hollow base with a one end of said money strip being placed inside of said spout extension, said end being pulled by said pull tab to release said money strip from said spout extension and said hollow base.

13. The money cake apparatus as recited in claim 12, further comprising a roll for mountably supporting said money strip in a rolled manner inside of said base.

14. The money cake apparatus as recited in claim 12, wherein said spout extension includes means for selectively adjusting its height.

15. The money cake apparatus as recited in claim 12, wherein said spout extensions number two.

16. The money cake apparatus as recited in claims 12 or 15, wherein said spout extensions are mounted on a pivoting member.

* * * * *